United States Patent [19]

Hiraki

[11] Patent Number: 5,040,585

[45] Date of Patent: Aug. 20, 1991

[54] SOLAR CELL PANEL ASSEMBLY FOR DRIVING A MOTOR-DRIVEN SCREEN APPARATUS

[75] Inventor: Yoshiharu Hiraki, Toyama, Japan

[73] Assignee: Yoshida Kogyo K. K., Tokyo, Japan

[21] Appl. No.: 517,493

[22] Filed: May 1, 1990

Related U.S. Application Data

[63] Continuation of Ser. No. 308,544, Feb. 10, 1989, abandoned.

[30] Foreign Application Priority Data

Feb. 12, 1988 [JP] Japan ..... 63-17404

[51] Int. Cl.[5] ..... E05F 15/00

[52] U.S. Cl. ..... 160/188; 52/788; 136/246; 136/251; 136/291; 160/166.1; 160/DIG. 17

[58] Field of Search ..... 136/246, 291, 251; 160/166.1, 188, DIG. 17; 52/788

[56] References Cited

FOREIGN PATENT DOCUMENTS 2827708 1/1979 Fed. Rep. of Germany ..... 136/246

60-178671 9/1985 Japan ..... 136/246

*Primary Examiner*—Aaron Weisstuch

*Attorney, Agent, or Firm*—Hill, Van Santen, Steadman & Simpson

[57] ABSTRACT

A solar cell panel assembly for supplying power to a motor-driven screen apparatus mounted for movement between an inside glass plate and an outside glass plate spaced therefrom in a double-glazed sliding door unit includes a belt-like sheet of solar cell panels having its bottom edge portion disposed via a plurality of mount members so as to be held in contact with the lower inside portion of the outer glass plate, extending in the horizontal direction along the lower inside portion of the outer glass plate, and inclined in such manner that its top end portion extends toward the inner glass plate. Preferably, the solar cell panel is provided with a glass panel mounted in tight contact with an outer light receiving surface of the solar cell panel, and transparent resin having a refractive index equivalent to that of glass is filled by potting in a wedge-shaped space formed between the glass panel and the inner surface of the outer glass plate. Also, preferably a reflector plate of an inverse-L shape in cross section having its upper surface formed as a reflecting surface, is disposed so as to reflect toward the outside lower portion of the outer glass plate and extend along the outside lower portion of the same glass plate.

4 Claims, 2 Drawing Sheets

SOLAR CELL PANEL ASSEMBLY FOR DRIVING A MOTOR-DRIVEN SCREEN APPARATUS

This is a continuation of application Ser. No. 308,544 filed 2/10/89 abandoned.

BACKGROUND OF THE INVENTION

1. Field of the Invention:

The present invention relates to a solar cell panel assembly for supplying power to a motor-driven screen apparatus such as, for instance, a motor-driven blind built within a double-glazed sliding door unit.

2. Description of the Prior Art:

With regard to a motor-operated blind powered by solar cells, various proposals have been made (for instance, see Japanese Utility Model Applications Laid-open Specification No. 60-31499), and in recent years, a screen apparatus in which a motor-driven blind 2 and a solar cell panel 3 are disposed within a double-glazed sliding door unit 1 as shown in FIG. 1, has been developed.

In such a construction, heretofore, the solar cell panel 3 was mounted vertically along the indoor side surface of a bottom portion of an outdoor side, or outer, glass plate 1A as shown in FIG. 2.

However, with such method of mounting the solar cell panel 3, there exists a problem in the summer when the altitude of the sun is high and the solar cell panel 3 is directed to the south wherein the angle of incidence of the sunlight is large. Thus, due to an increase in the amount of sunlight reflected away from the collector and a decrease in the light receiving area of the collector perpendicular to the sunlight, the solar cell panel 3 does not receive a sufficient amount of sunlight, and so, the output power of the solar cells is reduced.

SUMMARY OF THE INVENTION

The present invention resolves the aforementioned problem, and it is one object of the present invention to provide a solar cell panel assembly for supplying power to a motor-driven screen apparatus, which improves the light collecting efficiency with a relatively simple construction and thereby increases the output power of solar cells.

In order to achieve the aformentioned object, according to a first aspect of the present invention, there is provided a solar cell panel assembly for supplying power to a motor-driven screen apparatus including a belt-like sheet of solar cell panels having its bottom edge portion disposed via a plurality of mount members so as to be held in contact with a lower inside portion of an outer glass plate of a double-glazed sliding door unit having an outer glass plate, an inner glass plate and a motor-driven screen apparatus mounted in the space between the above-mentioned glass plates. The solar cell panel extends in the horizontal direction along the lower inside portion of the aforementioned outer glass plate, and is inclined in such manner that its top end portion extends toward the inner glass plate.

According to a second aspect of the present invention, there is provided a solar cell panel assembly for supplying power to a motor driven screen apparatus, characterized in that the solar cell panel described above in connection to the first aspect of the invention is provided with a glass panel mounted in tight contact with the outer light receiving surface of the solar cell panel, and a transparent resin having a refractive index equivalent to that of glass is filled by potting in a wedge-shaped space formed between the above-mentioned glass panel and the inside surface of the aforementioned outer glass plate.

Furthermore, according to a third aspect of the present invention, there is provided a solar cell panel assembly for supplying power to a motor-driven screen apparatus as described in connection to either the first aspect of the invention or the second aspect of the invention, characterized in that the assembly further includes one reflector plate of an inverse-L shape in cross section having its upper surface formed as a reflecting surface. The reflector plate projects toward the outdoor side from the outside lower portion of the above described outer glass plate and extends along the outside lower portion of the same glass plate.

Thus, according to the present invention, owing to the fact that the solar cell panel is disposed at an inclined attitude, the angle of incidence of the sunlight as measured from the normal of the plane of the solar cell panel becomes small as compared to that of the assembly in the prior art, hence the amount of reflected sunlight is reduced, also the area of the light receiving surface of the solar cell panel perpendicular to the sunlight is increased, and so, the light collecting efficiency is improved as compared to the assembly in the prior art, resulting in greater output power from the solar cells.

In addition, according to the present invention, by virtue of potting of transparent resin in the wedge shaped space between the solar cell panel and the outside glass plate, reflection loss of the sunlight is reduced. Furthermore, thanks to the reflector plate the sunlight that is not directly incident on the solar cell panel reflected onto the collector, and thereby the light collecting efficiency and the output power of the solar cells is improved.

The above-mentioned and other advantages, aspects and objects of the present invention will become obvious to those skilled in the prior art from the following description of one preferred embodiment of the invention taken in conjunction with the accompanying drawings.

DETAILED DESCRIPTION OF THE PREFERRED EMBODIMENT

In the following, the present invention will be described in greater detail in connection to the preferred embodiment of the invention shown in FIGS. 3 and 4.

Figure 1:
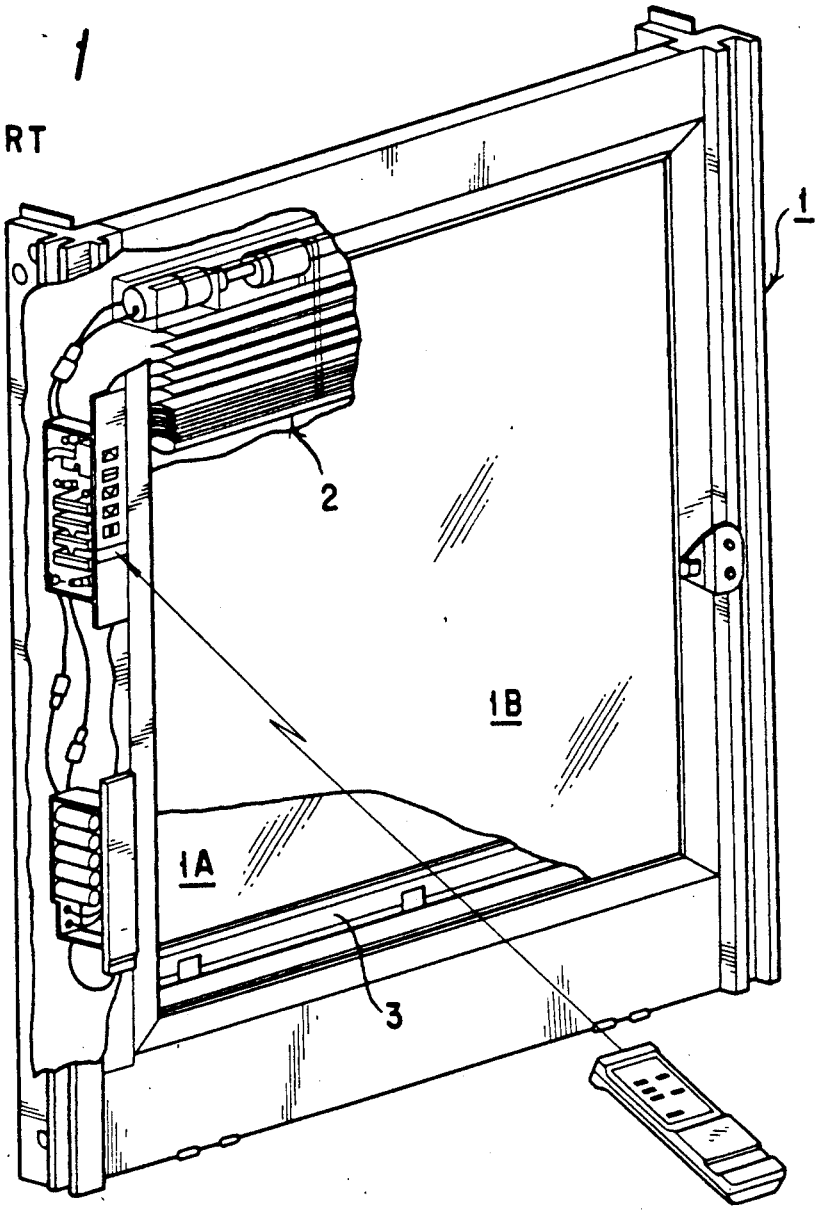
FIG. 1 PRIOR ART
FIG. 1 is a schematic perspective view partly cut away showing a double-glazed sliding door unit containing a motor-driven blind therein in the prior art.
Figure 2:
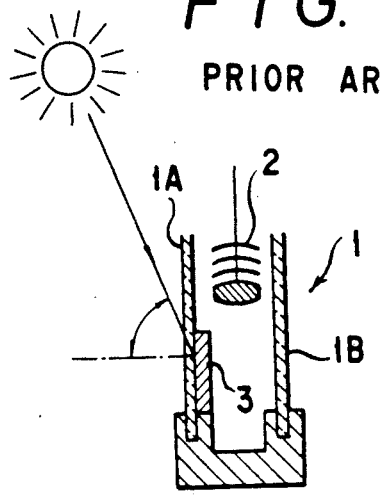
FIG. 2 PRIOR ART
FIG. 2 is a schematic vertical cross-section showing an essential part of a mount structure of a solar cell panel in the prior art.
Figure 3:
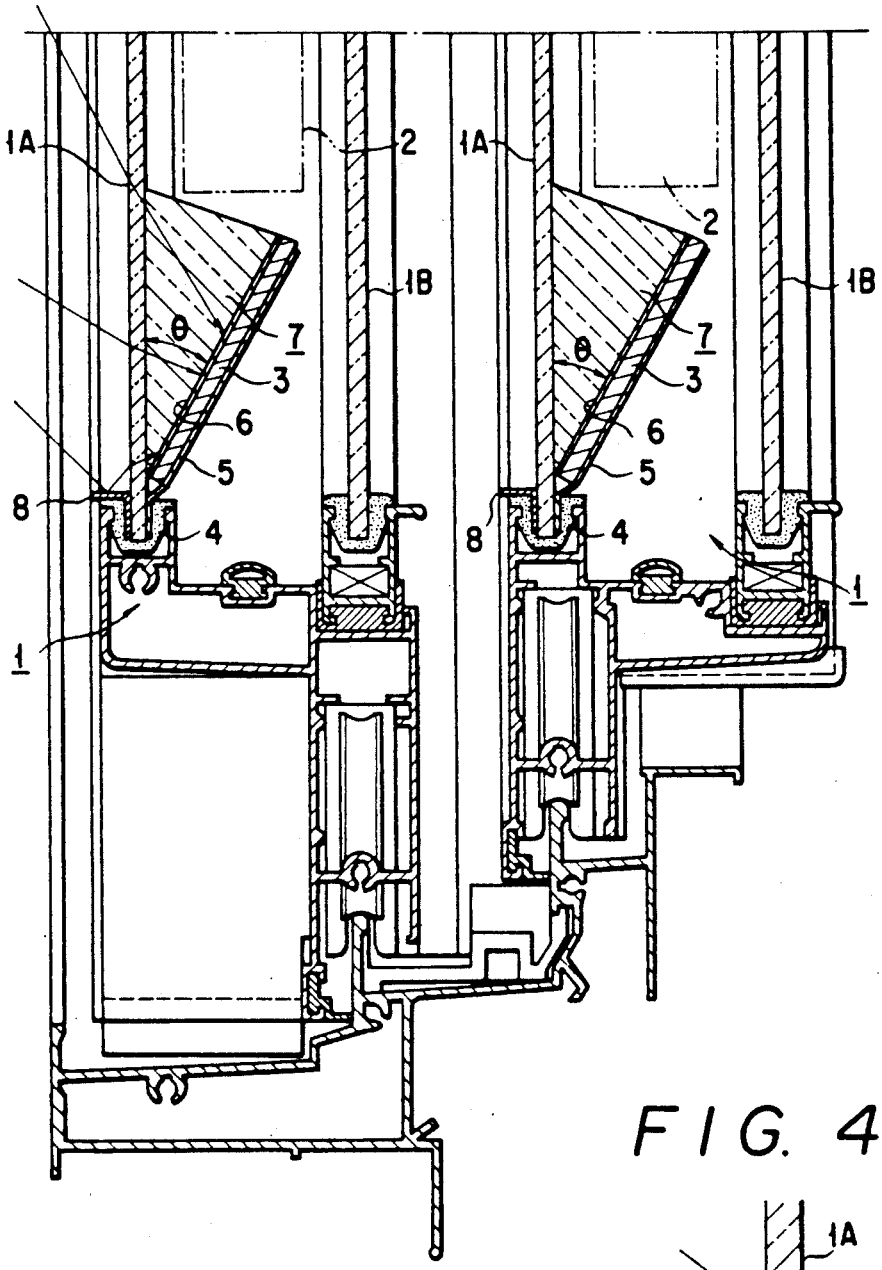
FIG. 3 is a vertical cross section showing an essential part of one preferred embodiment of the present invention.

FIG. 3 shows one preferred embodiment, in which a motor-driven blind 2 is disposed within a double-glazed sliding door unit 1 having an outer glass plate 1A and an inner glass plate 1B spaced from each other. In the illustrated arrangement, a solar cell panel 3 is disposed at the lowest portion on the inside of the outer glass plate 1A and is mounted at an inclination angle 0 so that its lower edge portion is positioned on a gasket 4 and its upper edge portion extends toward the inner glass plate.

Mounting of the solar cell panel 3 is effected by fixedly securing obliquely bent metal mounts 5 to the solar cell panel 3 at intervals in the lengthwise direction of the panel, and inserting the base portions of the metal mounts 5 between an inside surface of a groove in the gasket 4 and the inside surface of the outer glass plate 1A.

Figure 4:
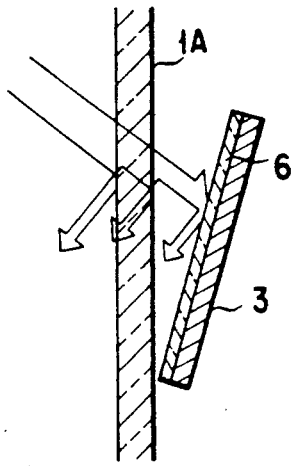
FIG. 4 is a schematic view illustrating reflection losses of the sunlight in the case where transparent resin is not potted in the wedge-shaped space between the outside glass plate and the solar cell panel.

Furthermore, because of the fact that if an air layer exists between the solar cell panel 3 and the outer glass plate 1A, then a relatively large reflection loss of light occurs at the boundary surface between the air layer and the glass plate or the solar cell panel as shown in FIG. 4. Therefore, a glass panel 6 is fixedly secured to a light receiving surface of the solar cell panel 3, and transparent resin 7 having a refractory index equivalent to that of glass (1.4–1.5) is filled by potting between this glass panel 6 and the outer glass plate 1A as shown in FIG. 3. It is to be noted that the top surface of the transparent resin 7 has a slope rising toward the outside glass plate.

Owing to such a potting process, no air layer is present on the light receiving side of the solar cell panel 3, but a substantially uniform layer is formed that is optically equivalent to an integral wedge-shaped glass layer, hence the reflection loss of light is reduced, and the light collecting efficiency is further improved.

In addition, on a gasket 4 on the outside of the outer glass plate 1A is disposed a reflector plate 8 of rust-proof material having a high reflectivity so that even light that is not directly incident on the collector is collected by reflection. This reflector plate 8 has an inverse-L shape in cross section, and its base portion is fixedly secured by being inserted between an inside surface of the gasket 4 and the outer glass plate 1A. It is to be noted that while the inclination angle 0 should be, ideally, as large as about 60 ° within the territory of Japan, in order to prevent the solar cell panel 3 from striking against the motor-operated blind 2, the inclination angle 0 is chosen to be 5°–10°. Also, it is a matter of course that if the arrangement is such that the motor-operated blind 2 would stop at a position above the solar cell panel 3, the inclination angle could be made larger than the above-specified range.

In the above-described construction, since the solar cell panel 3 is mounted with the inclination angle 0, the angle of incidence of the sunlight is smaller than that in the prior art, hence the amount of reflected light is reduced and the light receiving area perpendicular to the sunlight rays is increased. Therefore, the light collected efficiency of the light collector is improved as compared to the arrangement in the prior art. For instance, in the case where the inclination angle was chosen to be 10°, it was confirmed that an improvement in the output power of the solar cells by 20 to 30% is achieved in summer.

Furthermore, by potting the transparent resin 7 into the space between the solar cell and the outer glass plate, the reflection loss of the sunlight is reduced, also by providing the reflecting plate 8, light that is not directly incident on the collector is collected, and thereby the light collecting efficiency and the output power is enhanced. While the present invention has been described above in connection to a motor-driven blind, it is a matter of course that the present invention should not be limited to such application but it can be applied equally to general motor-driven screen apparatuses such a motor driven curtain, a motor-driven louver, etc.

I claim:

1. A motor driven screen apparatus, comprising:

a double-glazed sliding door unit having an outer glass plate and an inner glass plate spaced from said outer glass plate;

a motor-driven screen apparatus mounted between said outer glass plate and said inner glass plate;

a plurality of mount members at a lower inside surface of said outer glass plate adapted to hold a solar cell panel at an angle to said outer glass plate;

a solar cell panel having its bottm edge portion disposed via said plurality of mount members so as to be held in contact with said lower inside surface of said outer glass plate of said double-glazed sliding door unit, said solar cell panel extending in a horizontal direction along said lower inside surface of said outer glass plate, said solar cell panel being disposed at an incline in such manner that its top end portion extends toward said inner glass plate.

2. A motor driven screen apparatus as claimed in claim 1, further comprising:

a glass panel mounted in tight contact with an outside light receiving surface of the solar cell panel, and transparent resin having a refractive index equivalent to that of glass being filled by potting in a wedge-shaped space formed between said glass panel and said inside surface of said outer glass plate.

3. A motor driven screen apparatus as claimed in claim 2, further comprising:

a reflector plate of inverse-L shape in cross section having its upper surface formed as a reflecting surface, said reflector plate being disposed so as to reflect toward a lower outside surface of said outer glass plate and said relfector plate extending along a lower outside portion of said outer glass plate.

4. A motor driven screen apparatus as claimed in claim 1, further comprising:

a reflector plate of inverse-L shaped in cross section having its upper surface formed as a reflecting surface, said reflector plate being disposed so as to reflect light toward a lower outside surface of said outer glass plate, said reflector plate extending along a lower outside portion of said outer glass plate.

* * * * *